United States Patent [19]

Ziegenfus

[11] 4,429,636

[45] Feb. 7, 1984

[54] VEHICLE TURNTABLE

[75] Inventor: Barry L. Ziegenfus, Saylorsburg, Pa.

[73] Assignee: SI Handling Systems, Inc., Easton, Pa.

[21] Appl. No.: 330,351

[22] Filed: Dec. 14, 1981

[51] Int. Cl.[3] ..... B61J 1/02; B61B 13/12

[52] U.S. Cl. ..... 104/36; 104/35; 104/47; 104/166

[58] Field of Search ..... 104/35, 36, 38, 43, 104/47, 99, 165, 166; 198/369, 370, 414, 480, 800

[56] References Cited

U.S. PATENT DOCUMENTS

| | | | |
|---|---|---|---|
| 402,934 | 5/1889 | Judson | 104/166 |
| 423,872 | 3/1890 | Judson | 104/166 |
| 1,800,722 | 4/1931 | Edson | 104/38 |
| 3,650,216 | 3/1972 | Harwick et al. | 104/166 |
| 3,854,413 | 12/1974 | Broome | 104/166 |
| 3,858,626 | 1/1975 | Ribordy | 104/166 |
| 4,041,873 | 8/1977 | Jones | 104/35 |
| 4,059,053 | 11/1977 | Jones | 104/35 |
| 4,132,174 | 1/1979 | Ziegenfus et al. | 104/48 |
| 4,358,999 | 11/1982 | Nagahori | 104/166 |

FOREIGN PATENT DOCUMENTS

| | | | |
|---|---|---|---|
| 1079593 | 8/1967 | United Kingdom | 104/35 |

*Primary Examiner*—Randolph Reese

*Attorney, Agent, or Firm*—Seidel, Gonda & Goldhammer

[57] ABSTRACT

A driverless vehicle turntable includes a table pivotably mounted for movement about a vertical axis. The table has tracks and a drive tube as well as drive wheels. An arcuate drive tube assembly is arranged for frictional contact with the drive wheels.

15 Claims, 12 Drawing Figures

FIG. 8
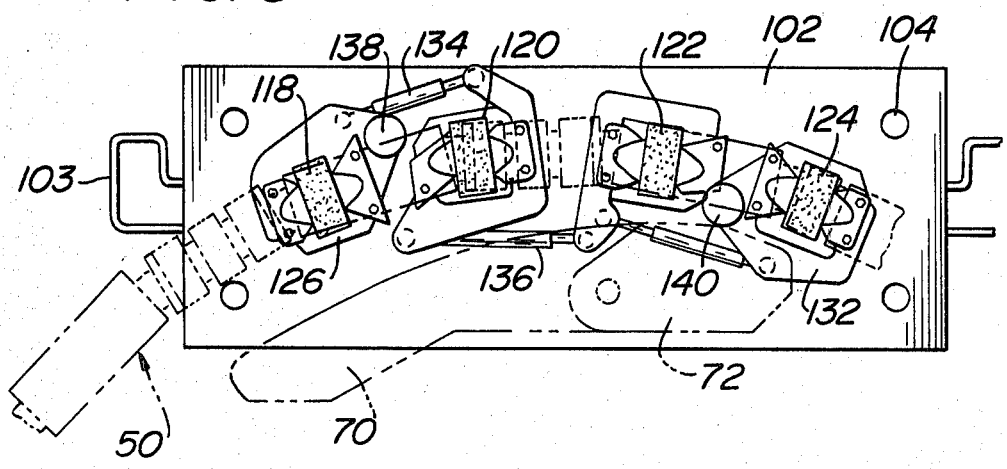
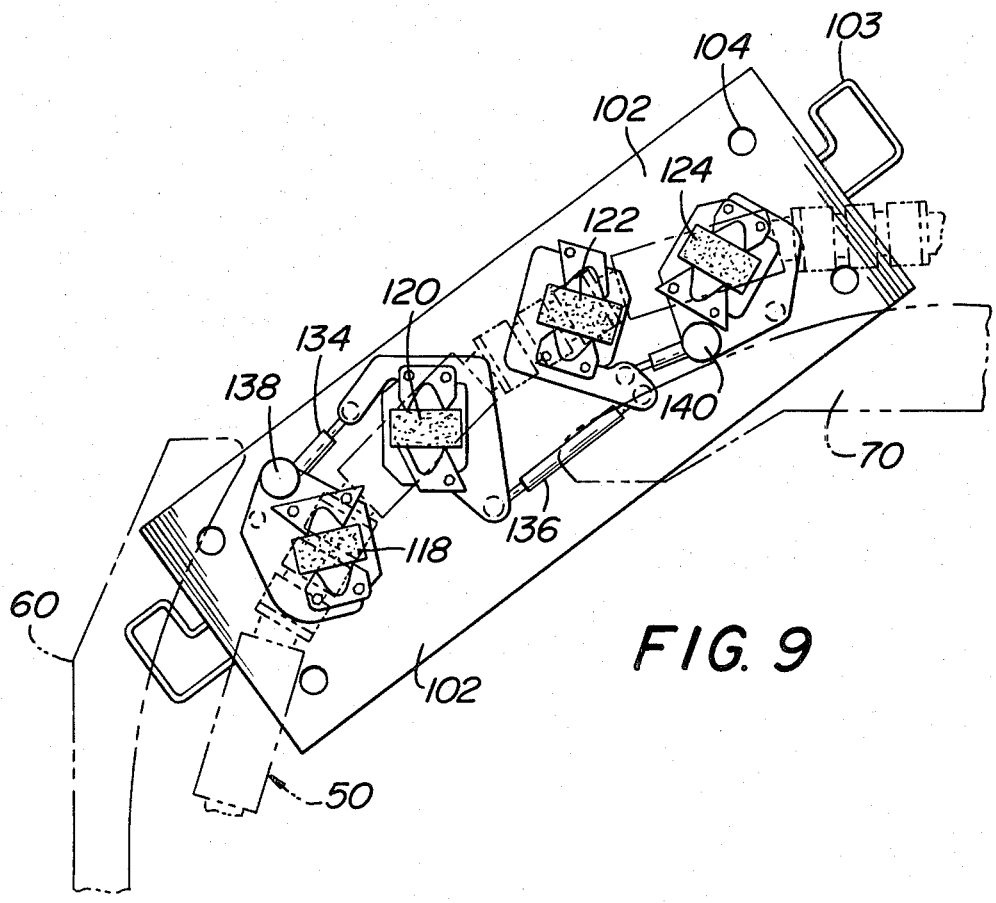
FIG. 9

VEHICLE TURNTABLE

BACKGROUND

Turntables for vehicles, and in particular driverless vehicles, are known. For example, see U.S. Pat. Nos. 4,041,873; 4,132,174 and 4,059,053. There is a need for a turntable which cannot be fulfilled by the turntables in said patents. Thus, the present invention is directed to a solution of the problem of a turntable with high reliability so that it may be used on a highspeed production line. The turntable is designed in a manner so that it will solve the problem of permitting the turntable to operate when the means for pivoting the turntable malfunctions. Further, the turntable of the present invention is designed in a manner to facilitate rapid replacement of a drive wheel assembly in the event of a malfunction.

SUMMARY OF THE INVENTION

The present invention is directed to a vehicle turntable which is pivotably mounted on a support for movement about a vertical axis. The table has tracks for a vehicle and has drive wheels. An arcuate drive tube assembly is provided. Said drive wheels are arranged for frictional contact with the drive tube assembly for causing the table to pivot about said axis. A motor is coupled to the drive tube assembly. The table is provided with latch means for latching the table in position at the ends of its movement.

It is an object of the present invention to provide a novel vehicle turntable which facilitates manual pivoting of the turntable in the event of a power failure whereby operation of a production line need not cease in the event of such power failure.

It is another object of the present invention to provide a turntable with a plurality of drive wheels which are readily removable as a unit in the event of a malfunction whereby downtime on a production line is minimized.

Other objects and advantages of the present invention will appear hereinafter.

For the purpose of illustrating the invention, there is shown in the drawings a form which is presently preferred; it being understood, however, that this invention is not limited to the precise arrangements and instrumentalities shown.

FIGS. 8–10 are composite plan views showing the different positions of the drive wheel assembly.

DETAILED DESCRIPTION

Figure 1:
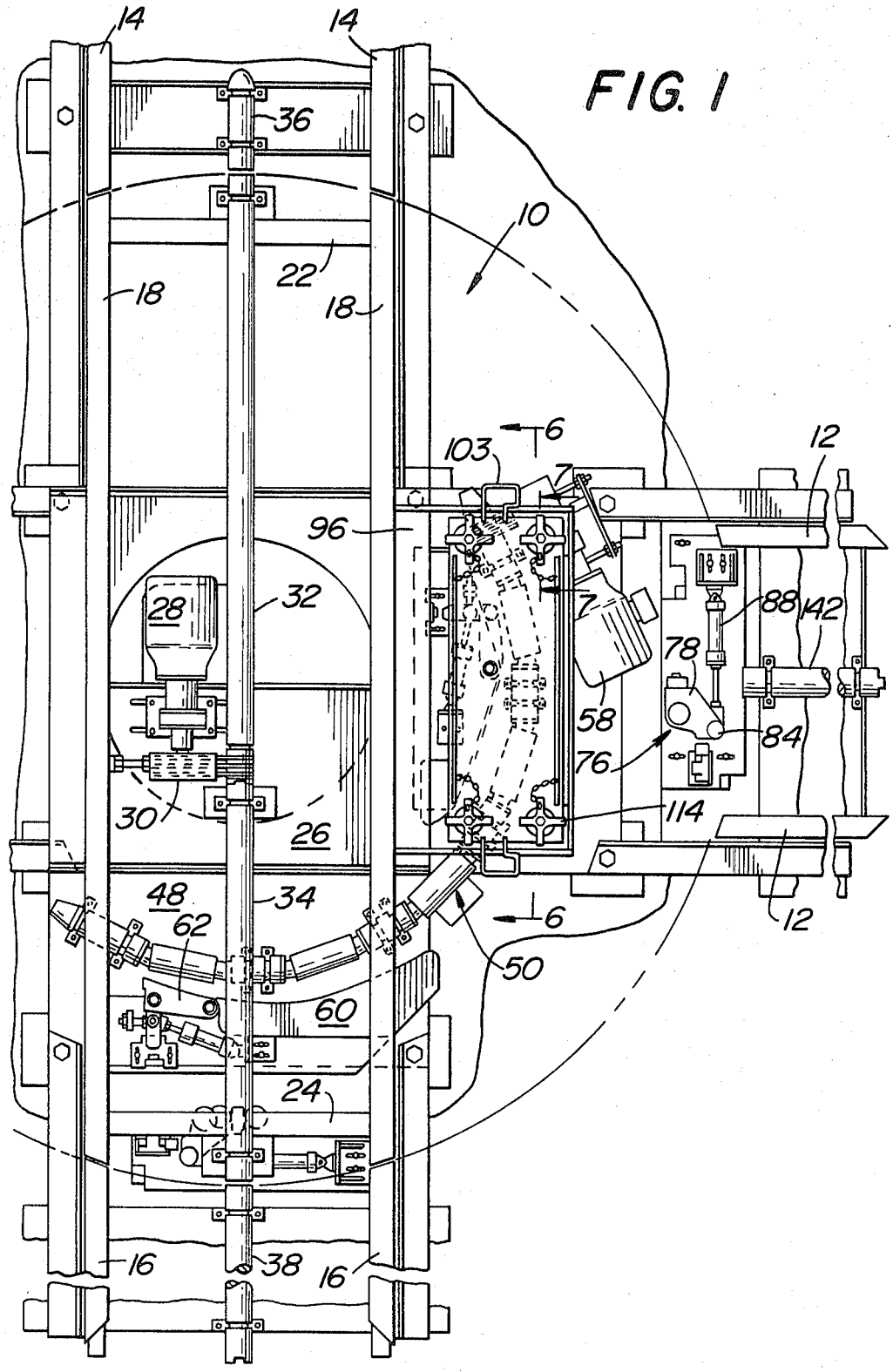
FIG. 1 is a top plan view of a turntable in accordance with the present invention.

Referring to the drawings in detail, wherein like numerals indicate like elements, there is shown in FIG. 1 a turntable in accordance with the present invention designated generally as 10. The turntable assembly 10 is adapted to receive driverless vehicles from a set of tracks 12 and deliver the same to a set of tracks 14 or a set of tracks 16 and vice versa. For the purposes of the present invention, the turntable 10 will be described in connection with transferring a vehicle from tracks 16 to tracks 12. Thus, the turntable 10 will be in the receiving position to receive a vehicle from track 16 as shown in FIG. 1 and will thereafter pivot through an arc of 90° to facilitate transferring the vehicle off the turntable 10 and onto the tracks 12.

Figure 3:
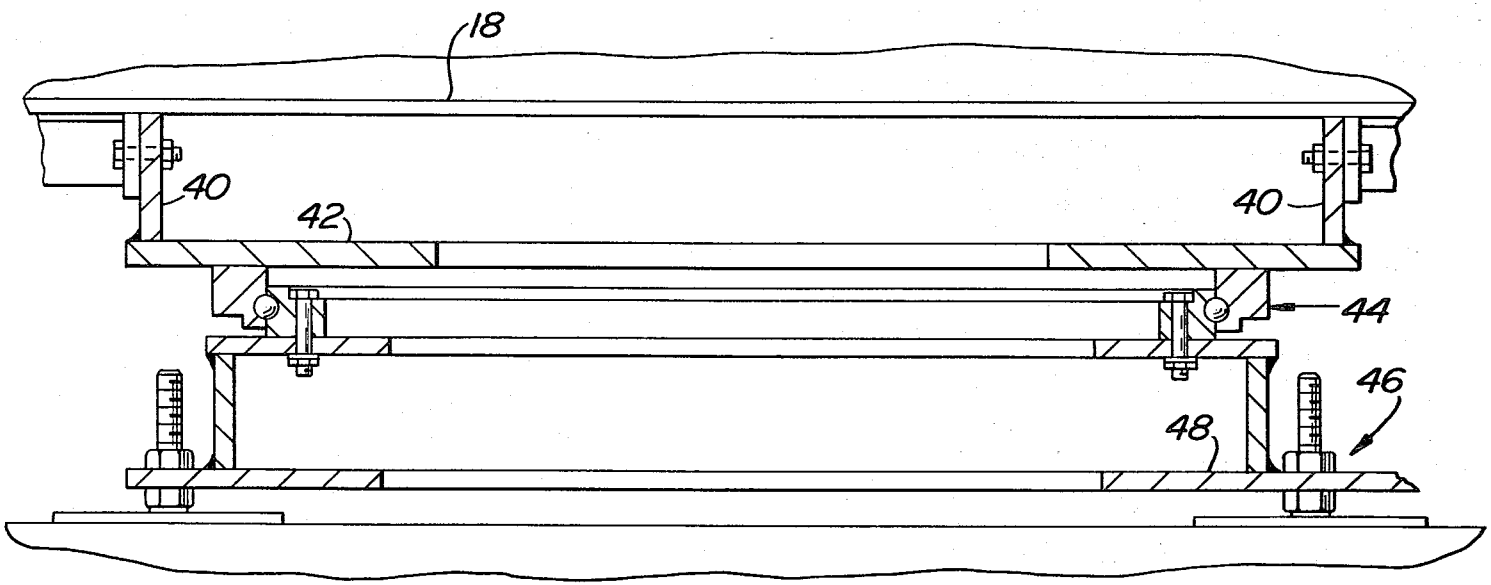
FIG. 3 is a sectional view taken along the line 3—3 in FIG. 2 but with the turntable mounted on the support.

The turntable 10 includes a pair of tracks 18 aligned with the tracks 16. Each track 18 is mounted on a side rail. See FIG. 3. Adjacent one end of the tracks 18, the side rails are connected together by a brace 22. A brace 24 connects the side rails adjacent their other end. In a central portion of the turntable 10, the side rails are interconnected by a support plate 26 which supports the motor 28 and speed reducer 30. The speed reducer 30 is connected to drive tube 32 by way of endless belts. Drive tube 32 is coupled to drive tube 34 coaxial therewith. Motor 28 rotates the drive tubes 32, 34 about their longitudinal axes. A drive tube 36 is associated with the tracks 14. A drive tube 38 is associated with the tracks 16. The table 10 is provided with conventional structure (not shown) for causing a vehicle to come to a stop while a vehicle is supported by the tracks 18 as well as other conventional structure not shown such as switches.

The side rails 20 are connected by braces 40 to a support structure including horizontally disposed plate 42. See FIG. 3. Plate 42 is connected by way of roller bearing 44 to a floor mounted substructure designated generally as 46. The substructure 46 includes a baseplate 48. To reduce the weight of the entire turntable, plates 42 and 48 are provided with a circular opening as shown more clearly in FIGS. 2 and 3.

On the baseplate 48, there is provided a drive tube assembly designated generally as 50. The drive tube assembly is arcuate in nature and extends for an arc of approximately 180° about the axis of the holes in the plates 42, 48 and is coaxial with the circular bearing 44. The drive tube assembly 50 is comprised of a series of short drive tubes 52 interposed between and interconnected with longer drive tubes 54. One of the drive tubes at an end of the drive tube assembly 50 is connected by way of endless belts to the speed reducer 56 of a drive motor 58. Motor 58 causes each drive tube section of the drive tube assembly to rotate about its longitudinal axis.

Radially outwardly of the drive tube asembly 50, there is provided a fixed cam 60 coextensive with a movable cam 62. See FIG. 2. Cams 60 and 62 are adjacent the free end of the track 16 as shown more clearly in FIG. 1.

Figure 12:
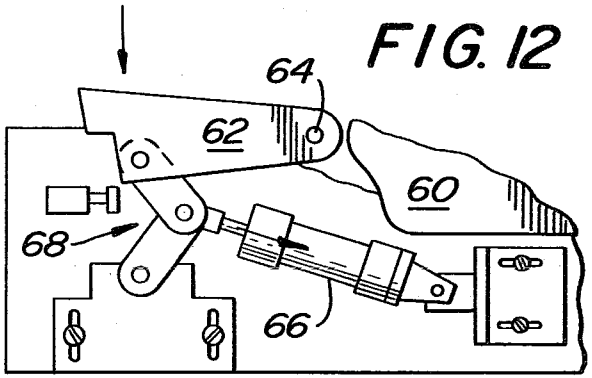
FIGS. 11–12 show different positions of portions of one of the cams.
Figure 11:
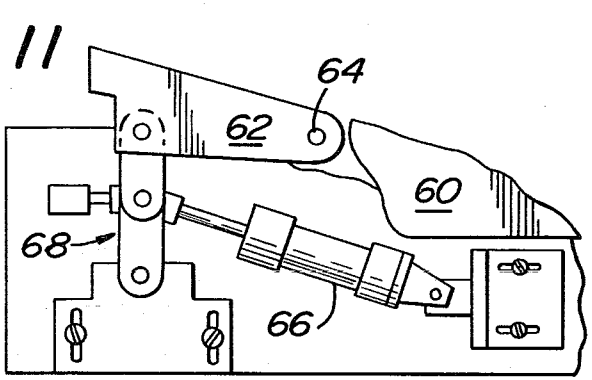

As shown more clearly in FIGS. 11 and 12, cam 62 is provided with a pivot 64. As shown in FIG. 11, the inner camming surface of cam 62 is aligned with the inner camming surface of the cam 60 to thereby cause the turntable to come to a stop. As shown more clearly in FIG. 12, the cam 62 is in a release position. A cylinder 66 has one end pivotably mounted to the support. A piston rod from the other end of the cylinder is connected to the links of a clevis 68 which has an over-the-center position when arranged as shown in FIG. 11.

Referring again to FIG. 2, that portion of the drive assembly 50 opposite the tracks 12 is provided inwardly thereof with cams 70 and 72. Cam 70 matches cam 60 and cam 72 matches cam 62. Cam 72 is provided with a cylinder actuator 74 which matches cylinder 66. Cams 60, 62 control acceleration and deceleration of the turntable 10 at one end of its movement while cams 70, 72 control acceleration and deceleration of the turntable 10 at the other end of its movement. The respective cams are on opposite sides of the drive tube assembly 50 as shown more clearly in FIG. 2.

When the turntable 10 is at either end of its movement, and therefore aligned with either the tracks 12 or the track 16, it is necessary to provide the turntable 10 with a latching means. A wide variety of latching means may be utilized. The preferred latching means for each end of the movement of the turntable 10 is identical. Hence, only the latching means 76 opposite the free ends of track 12 will be described in detail.

Figure 4:
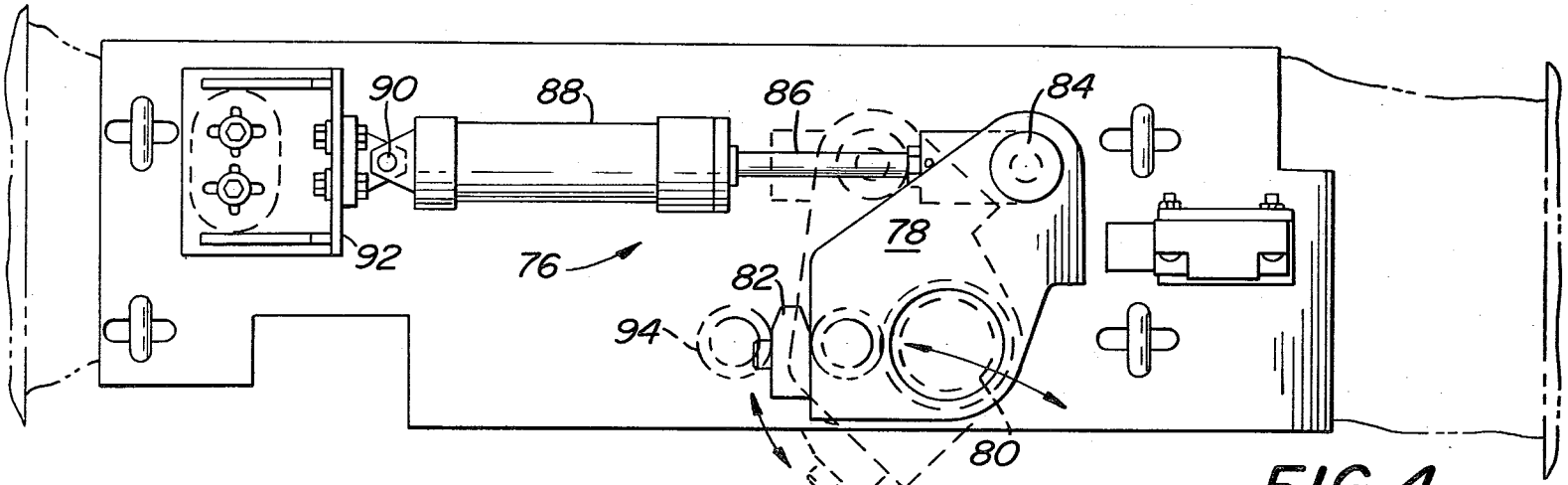
FIG. 4 is an enlarged plan view of the latching means shown in FIG. 1.
Figure 5:
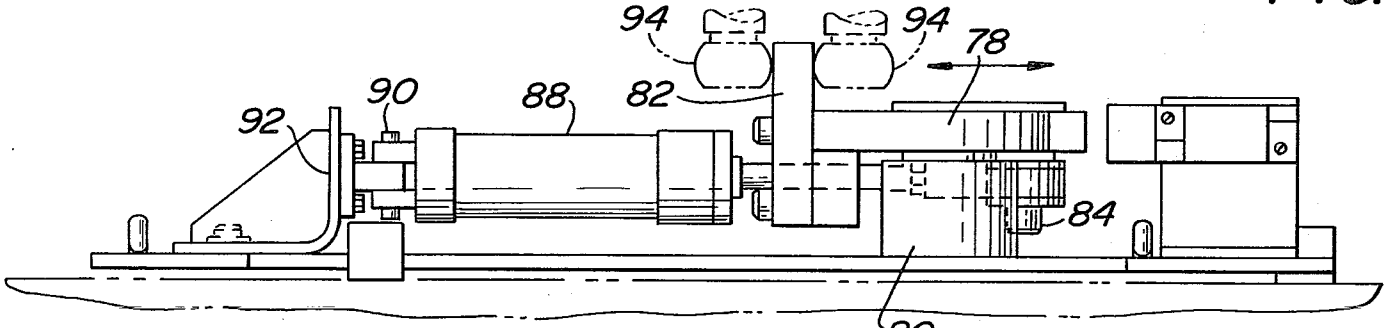
FIG. 5 is an elevation view of the latching means shown in FIG. 4.

Referring to FIGS. 4 and 5, there is provided a plate 78 mounted for pivotable movement about a vertical axis on bearing 80. An upstanding guide 82 is secured to a side face of the plate 78. Plate 78 is connected by way of pivot 84 to one end of a piston rod 86. The piston rod 86 is connected to a piston within the cylinder 88. Cylinder 88 is pivotably connected by way of pin 90 to a bracket 92. The components are illustrated in their actuated or operative position wherein the guide 82 is pivoted to a position whereby it is disposed between and in rolling contact with rollers 94 which depend from a brace on the turntable 10.

Figure 6:
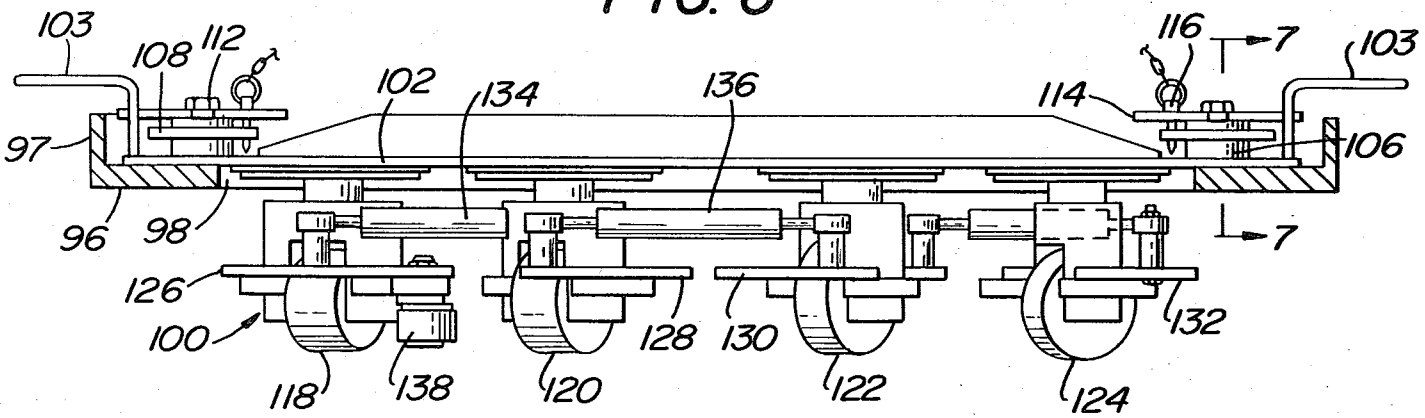
FIG. 6 is a sectional view taken along the line 6—6 in FIG. 1.

Referring to FIGS. 1 and 6, a support 96 projects horizontally from a side face of one of the side rails 20 toward the tracks 12. The support 96 has an upstanding flange 97 and a hole 98 in a horizontally disposed portion thereof. The hole 98 is rectangular and overlies one end portion of the drive tube assembly 50 as indicated by the phantom lines in FIG. 1. A drive wheel assembly 100 is removably mounted on the support 96.

The drive wheel assembly 100 includes a plate 102 having a larger peripheral contour than the hole 98 with a handle 103 at each end. Handles 103 project upwardly and outwardly and are in the shape of a handle grip.

Figure 7:
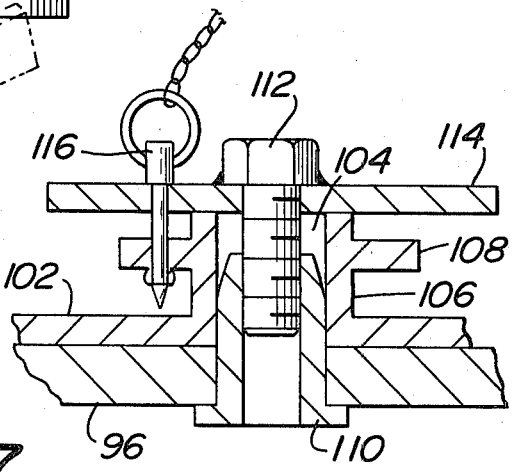
FIG. 7 is a sectional view taken along the line 7—7 in FIG. 6.

The assembly 100 is removably attached to the support 96 in the following manner. Plate 102 has a plurality of holes 104 defined by upstanding boss 106. See FIG. 7. Boss 106 has a radially outwardly extending flange 108. A ferrule 110 extends through a hole in the support 96 and into the hole 104. A bolt 112 is threaded to the ferrule and has an extension 114 of crucifix shape. A safety pin 116 extends through a hole in extension 114 and the flange 108. To remove the assembly 100, each extension 114 is rotated to release the connection between bolt 112 and ferrule 110 after first removing the safety pins 116. Thereafter, the entire assembly 100 may be raised vertically by lifting force supplied to the handles 103.

The drive wheel assembly 100 includes drive wheels 118, 120, 122 and 124. A greater or lesser number of drive wheels may be provided depending upon the load to be pivoted. Each drive wheel is oscillatable about a vertical axis between a drive position and an accumulation position. Each drive wheel is spring biased to its drive position. In addition, each drive wheel can be moved vertically for a short distance against spring pressure so as to be certain that each drive wheel will be spring biased into frictional contact with the drive wheels of the tube assembly 50.

A flange 126 is attached to the yoke of the drive wheel 118. A flange 128 is attached to the yoke of drive wheel 120. A flange 130 is attached to the yoke of drive wheel 122. A flange 132 is attached to the yoke of drive wheel 124. Each of the drive wheel flanges is connected to the next adjacent flange. Thus, a link 134 is pivotably connected at its end to each of the flanges 126 and 128. A link 126 is pivotably connected at each of its ends to the flanges 128 and 130. Thus, each drive wheel is coupled to the next adjacent drive wheel so that they move in unison between their drive and accumulation positions. Links 134, 136, etc. are preferably adjustable in length.

Figure 10:
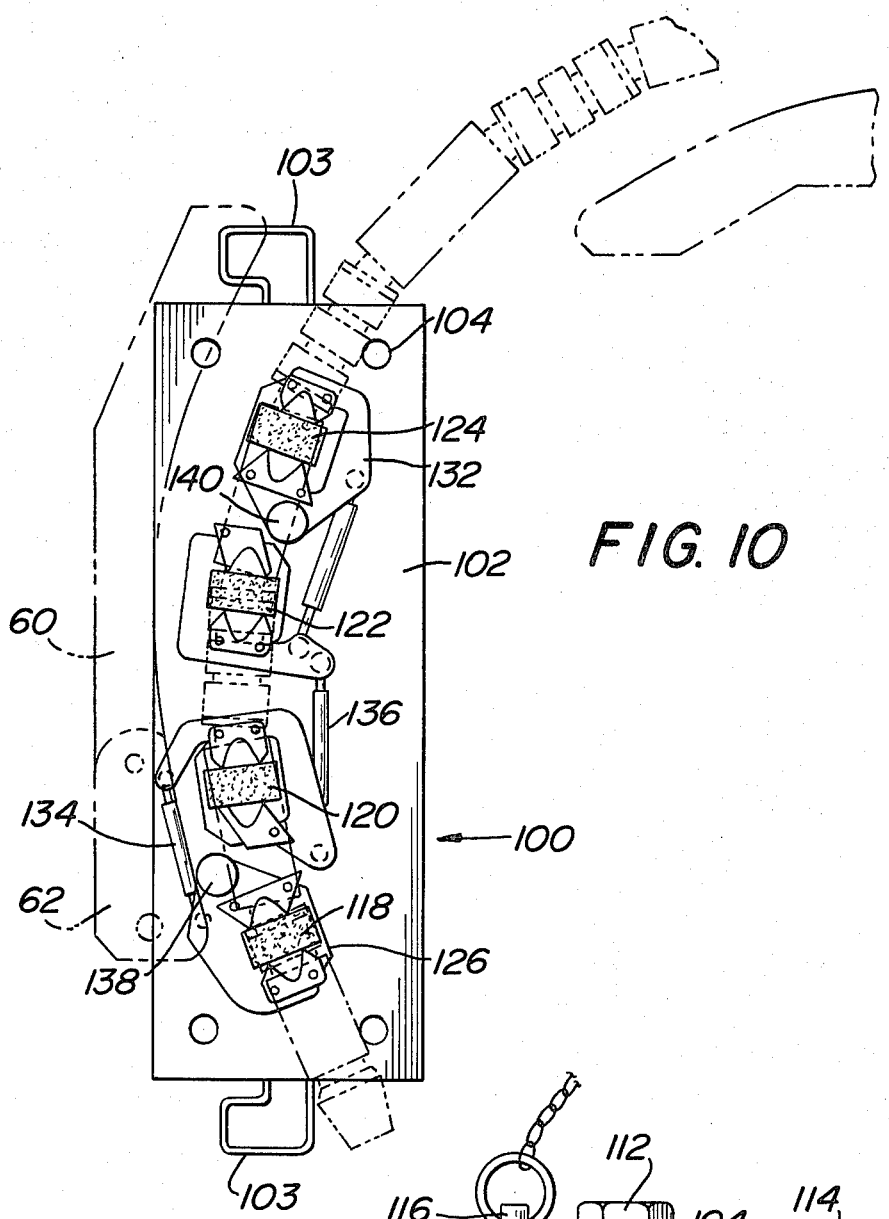

Referring to FIGS. 8–10, it will be noted that the drive wheels are angularly disposed so as to lie along an arc corresponding to the arc of the drive tube assembly 50. In FIG. 8, each drive wheel is in an accumulation position and the turntable 10 is positioned as shown. In FIG. 9, each drive wheel is in a drive position as would be the situation when turntable 10 has rotated about 45° from the position shown in FIG. 1. FIG. 10 shows the drive wheels when in an accumulation position adjacent tracks 16 during discharge of a vehicle onto tracks 12. Flange 126 has a cam follower 138 on one side of the drive wheels. Flange 132 has a cam follower 140 on the other side of the drive wheels. See FIG. 8.

Figure 2:
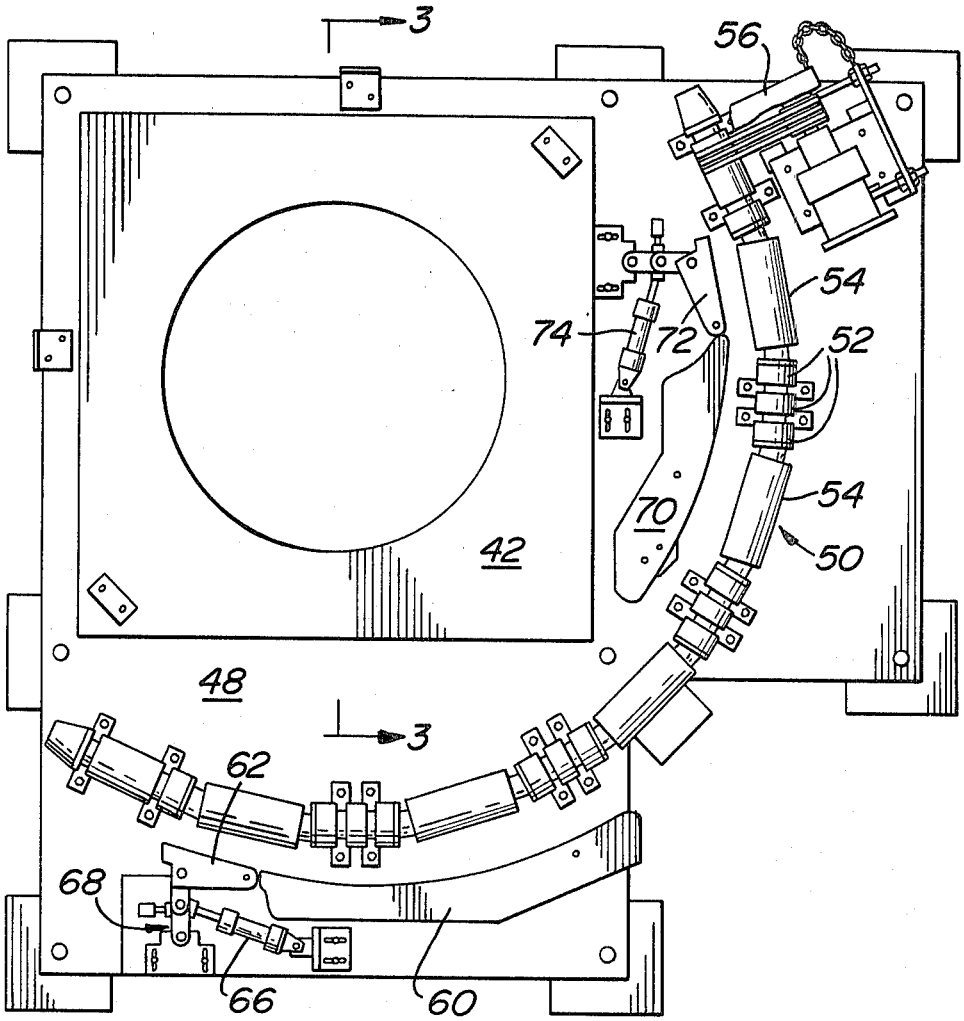
FIG. 2 is a view similar to FIG. 1 but with the turntable removed to show the support therebelow and the drive tube assembly.

The turntable 10 is used as follows. If the turntable 10 is not in a position to receive a driverless vehicle as shown in FIG. 1, a device along tracks 16 will stop the vehicle. Assuming the turntable is in the position as shown in FIG. 1, the vehicle will be driven onto the turntable 10 by frictional contact between drive tube 38 and drive wheels on the vehicle. When the driverless vehicle is received onto the tracks 18, the drive wheels on the vehicle will be cammed to a stop position by conventional structure not shown. Simultaneously, a microswitch or proximity switch will be tripped by the vehicle to start the motor 58 and cause the cam 72 to move to an inoperative position from the operative position as shown in FIGS. 2 and 8.

Motor 58 rotates the drive tube assembly 50. The drive wheels 118, 120, 122 and 124 are now biased to the drive position as shown in FIG. 9. Frictional contact between the drive wheels and the drive tube assembly causes the turntable to oscillate as the drive wheels move along the drive tube assembly 50. After the turntable 10 is rotated approximately 45° in a clockwise direction in FIG. 1, the cam follower 138 contacts the cam surface on cam 60 and begins to decelerate the oscillation of the turntable 10 in a controlled manner. When the cam follower 138 is in contact with cam 62, it is moved to a position wherein the drive wheels assume an accumulation or stop position as shown in FIG. 10. A microswitch or proximity switch is tripped by the turntable to thereby actuate cylinder 88.

When cylinder 88 is actuated, the plate 78 is pivoted to a position wherein the guide 82 will be disposed between and in contact with the guide rollers 94 thereby latching the turntable 10 in a discharge position. At the same time, a switch will be tripped to cause motor 28 to start rotating in a direction which will cause the vehicle to transfer off the tracks 18 and onto the tracks 12. When the vehicle is transferred onto the tracks 12, the drive wheels on the vehicle will be driven by frictional contact with the drive tube 142. When the vehicle has been transferred completely onto the tracks 12, a microswitch or proximity switch will be triggered to release the latch means 76, move cam 62 to an inoperative position (FIG. 12) thereby releasing cam follower 138, and start motor 58 in an opposite direction so that the turntable 10 will be driven back to the position as shown in FIG. 1 where again it will be latched by the latch means adjacent the ends of track 16.

In the event that there is a failure of motor 58, the precision roller bearing 44 will facilitate pivoting of turntable 10 manually. In an operative embodiment of the invention, the turntable 10 will pivot with the operator only pushing with one hand. Such manual oscillation of the turntable may also be needed if there is a misadjustment or defect associated with the drive wheel assembly 100. The drive wheel assembly 100 may be rapidly removed and replaced with a new assembly merely by rotating the extensions 114 to a released position and vertically lifting the entire assembly 100 by way of the handles 103. As a result thereof, downtime of the assembly line will be minimized.

The present invention may be embodied in other specific forms without departing from the spirit or essential attributes thereof and, accordingly, reference should be made to the appended claims, rather than to the foregoing specification, as indicating the scope of the invention.

I claim:

1. A turntable comprising a support, a table pivotably mounted on the support for movement about a vertical axis, said table having tracks for supporting a vehicle, said table having drive wheels depending therefrom, an arcuate drive tube assembly, said drive wheels being arcuately arranged about said axis for driving frictional contact with said assembly for causing said table to pivot about said axis, a drive motor coupled to aid drive tube assembly for rotating said drive tube assembly about its longitudinal axis, and latch means for latching said table in a position at the ends of its movement.

2. A turntable in accordance with claim 1 including means supporting the drive wheels on said table for rapid removal as a unit.

3. A turntable in accordance with claim 1 wherein said table is pivotably mounted on said support by a bearing which facilitates manual pivoting of the table.

4. A turntable in accordance with claim 1 including first cam means adjacent one end of the arcuate drive tube assembly along an inner periphery thereof and second cam means adjacent the other end portion of the drive tube assembly on the outer periphery thereof for controlling acceleration and deceleration of said table pivoting movement.

5. A turntable in accordance with claim 1 wherein said vertical axis is the center of curvature of said arcuate drive tube assembly.

6. A turntable in accordance with claim 1 wherein said drive wheels are mounted on a common support plate attached to a side face of the turntable and to one side of said table tracks.

7. A turntable in accordance with claim 1 wherein said drive wheels are positioned radially inwardly from the periphery of said turntable, and said assembly being arranged radially inwardly from the periphery of said table below the elevation of said table, said support having means for enabling said table to be supported by a floor.

8. A turntable in accordance with claim 1 wherein said assembly extends for an arc of about 180°.

9. A turntable for driverless vehicles comprising a support, a table pivotably mounted on the support by an annular bearing for movement of the table about a vertical axis, a pair of tracks on the table for receiving a driverless vehicle, a drive tube on the table between said tracks, a motor on the table for rotating said drive tube about its longitudinal axis, said table supporting a set of drive wheels rotatable about different horizontal axes, an arcuate drive tube assembly coaxial with said axes, said drive wheels being arranged for frictional driving contact with said assembly for causing said table to pivot about said axis, a motor coupled to said drive tube assembly for rotating the drive tube assembly about its longitudinal axis, discrete cams adjacent opposite ends of said drive tube assembly for controlling acceleration and deceleration of the table pivotable movement, and latch means for latching said table in position at the ends of its pivotable movement.

10. A turntable in accordance with claim 9 including an actuator associated with each cam for selectively moving at least a downstream end portion of said cam between an operative and inoperative position.

11. A turntable in accordance with claim 9 wherein said drive tube assembly includes a plurality of straight cylindrical tubes connected end-to-end.

12. A turntable in accordance with claim 9 wherein said drive wheels are mounted on a common support removably attached to a side of said turntable for removal as a unit.

13. A turntable in accordance with claim 9 wherein said assembly is radially inwardly from the periphery of said table and extends for an arc of approximately 180°.

14. A turntable in accordance with claim 9 wherein one of said cams is adjacent one end of the drive tube assembly along an inner periphery thereof, another of said cams being adjacent the other end of the drive tube assembly on the outer periphery thereof.

15. A turntable comprising a support adapted at its lower end for mounting on a floor, a horizontally disposed table mounted on the upper end of said support for pivotable movement about a vertical axis, said table having tracks for supporting a driverless vehicle, said table having drive wheels depending downwardly therefrom, an arcuate drive tube assembly having said axis as its center of curvature, said drive wheels being arcuately arranged about said axis for driving frictional contact with said assembly for causing said table to pivot about said axis, means supporting the drive wheels on said table for rapid removal as a unit, said last mentioned means including a common support plate removably attached to said table, first cam means adjacent one end of the drive tube assembly along the inner periphery thereof and second cam means adjacent the other end portion of the drive tube assembly on the outer periphery thereof for controlling acceleration and deceleration of said table pivoting movement, a drive motor coupled to said drive tube assembly for rotating said drive tube assembly about its longitudinal axis, the arcuate extent of said drive tube assembly being approximately 180°, and latch means for latching said table in a position at the ends of its movement.

* * * * *